US011435677B2

(12) United States Patent
Tanaka et al.

(10) Patent No.: US 11,435,677 B2
(45) Date of Patent: Sep. 6, 2022

(54) IMAGE FORMING APPARATUS INCLUDING A FOGGING TONER AMOUNT ESTIMATION SECTION

(71) Applicant: KYOCERA Document Solutions Inc., Osaka (JP)

(72) Inventors: Kazunori Tanaka, Osaka (JP); Yoshihiro Yamagishi, Saka (JP); Tamotsu Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/210,390

(22) Filed: Mar. 23, 2021

(65) Prior Publication Data

US 2021/0302869 A1 Sep. 30, 2021

(30) Foreign Application Priority Data

Mar. 25, 2020 (JP) ..... JP2020-054339

(51) Int. Cl.

*G03G 15/06* (2006.01)
*G03G 15/00* (2006.01)
*G03G 15/02* (2006.01)

(52) U.S. Cl.

CPC ..... *G03G 15/065* (2013.01); *G03G 15/0266* (2013.01); *G03G 15/5037* (2013.01)

(58) Field of Classification Search

CPC ..... G03G 15/065; G03G 15/0266; G03G 15/5037; G03G 15/5041

See application file for complete search history.

(56) References Cited

U.S. PATENT DOCUMENTS

2008/0253780 A1* 10/2008 Nishimura ..... G03G 15/5062 399/50

FOREIGN PATENT DOCUMENTS

JP 2003-295540 A 10/2003

* cited by examiner

*Primary Examiner* — Arlene Heredia

(74) *Attorney, Agent, or Firm* — Studebaker & Brackett PC

(57) ABSTRACT

An image forming apparatus includes: a development device which develops an electrostatic latent image formed on a photosensitive drum into a toner image; a charger which charges the photosensitive drum; a development power supply which applies a bias voltage to the development device; a calculating section which calculates a surface potential of the photosensitive drum based on a development current flowing in the development device; and an estimating section which estimates a fogging toner amount. The fogging toner amount is an amount of toner moved due to fogging. When the fogging toner amount estimated by the estimating section is less than a prescribed threshold, the calculating section calculates a value of the bias voltage at which the development current stops flowing as the surface potential.

5 Claims, 6 Drawing Sheets

IMAGE FORMING APPARATUS INCLUDING A FOGGING TONER AMOUNT ESTIMATION SECTION

INCORPORATION BY REFERENCE

The present application claims priority under 35 U.S.C. § 119 to Japanese Patent Application No. 2020-054339, filed on Mar. 25, 2020. The contents of this application are incorporated herein by reference in their entirety.

BACKGROUND

The present disclosure relates to an image forming apparatus.

In electrographic image forming apparatuses such as copiers or printers, an image formation process is widely used in which toner is attached to an electrostatic latent image formed by irradiating the uniformly charged surface of a photosensitive drum (image bearing member) with light to develop the electrostatic latent image into a toner image. To obtain a high-quality image, it is necessary to perform development using a development bias with an adequate potential difference from the surface potential of the photosensitive drum.

To that end, it is necessary to detect the actual surface potential of the photosensitive drum when forming an image, and the surface potential of the photosensitive drum has conventionally been detected using a surface potential sensor.

However, a surface potential sensor is problematic in that it is high in cost and cannot measure accurately once scattered toner or the like attaches to the photosensitive drum. Therefore, a technique of obtaining the surface potential of a photosensitive drum without using a high-cost sensor such as a surface potential sensor is offered.

For example, an electrophotographic apparatus obtains the surface potential of a photosensitive member by forming a pulse-shaped electrostatic potential pattern on the photosensitive member, applying a bias to a development roller, and measuring the electric current flowing into the development roller from the photosensitive member when the electrostatic potential pattern is developed. Specifically, the surface potential of the photosensitive member is estimated by monitoring the electric current in the alternating points of the pulse-shaped electrostatic potential pattern. In this manner, the surface potential of the photosensitive member can be obtained without using a surface potential sensor.

SUMMARY

An image forming apparatus according to an aspect of the present disclosure includes an image bearing member, a charger, a development device, a development power supply, an electric current measuring section, a calculating section, and an estimating section. The image bearing member has a surface on which an electrostatic latent image is formed. The charger charges the image bearing member. The development device develops the electrostatic latent image formed on the image bearing member into a toner image by supplying a toner to the image bearing member. The development power supply applies a bias voltage to the development device. The electric current measuring section measures a development current flowing in the development device. The calculating section calculates a surface potential of the image bearing member based on the development current measured by the electric current measuring section.

The estimating section estimates a fogging toner amount. The fogging toner amount is an amount of toner moved due to fogging. The electric current measuring section measures the development current that flows in the development device in a charged state in which the charger has charged the image bearing member. When the fogging toner amount estimated by the estimating section is less than a prescribed threshold, the calculating section calculates a value of the bias voltage at which the development current stops flowing as the surface potential.

DETAILED DESCRIPTION

Figure 1:
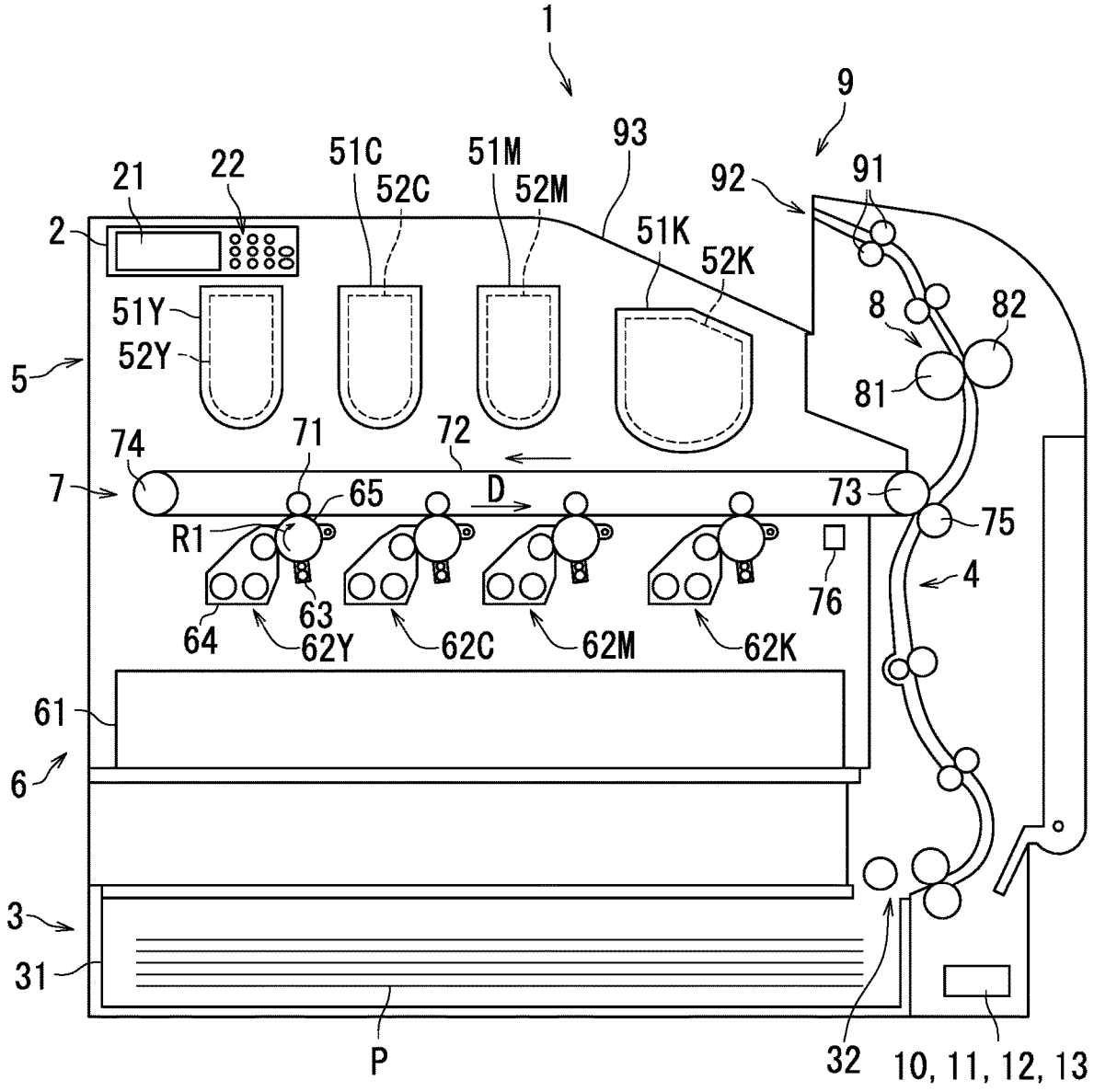
FIG. 1 is a diagram illustrating an example of the configuration of an image forming apparatus according to an embodiment of the present disclosure.

The following describes an embodiment of the present disclosure with reference to the accompanying drawings. Note that elements that are the same or equivalent are labeled with the same reference signs in the drawings and description thereof is not repeated.

A configuration of an image forming apparatus 1 according to the embodiment of the present disclosure is described with reference to FIG. 1. FIG. 1 is a diagram illustrating an example of the configuration of the image forming apparatus 1. The image forming apparatus 1 is a tandem color printer, for example.

As illustrated in FIG. 1, the image forming apparatus 1 includes an operation section 2, a sheet feed section 3, a conveyance section 4, a toner replenishing section 5, an image forming section 6, a transferring section 7, a fixing section 8, an ejection section 9, and a controller 10.

The operation section 2 receives an instruction from a user. Upon receiving the instruction from the user, the operation section 2 sends a signal indicating the instruction from the user to the controller 10. The operation section 2 includes a liquid-crystal display 21 and a plurality of operation keys 22. The liquid-crystal display 21 displays various processing results, for example. The operation keys 22 include a numeric keypad and a start key, for example. When an instruction indicating execution of image formation processing is input, the operation section 2 sends a signal indicating execution of the image formation processing to the controller 10. As a result, an image formation operation by the image forming apparatus 1 is started.

The sheet feed section 3 includes a sheet feed cassette 31 and a sheet feed roller group 32. The sheet feed cassette 31 houses a plurality of sheets P. The sheet feed roller group 32 feeds the sheets P housed in the sheet feed cassette 31 a sheet at a time to the conveyance section 4. A sheet P is an example of a recording medium.

The conveyance section 4 includes a roller and a guide member. The conveyance section 4 extends from the sheet feed section 3 to the ejection section 9. The conveyance section 4 conveys a sheet P from the sheet feed section 3 to the ejection section 9 by way of the image forming section 6 and the fixing section 8.

The toner replenishing section 5 replenishes the image forming section 6 with toner. The toner replenishing section 5 includes a first attachment section 51Y, a second attachment section 51C, a third attachment section 51M, and a fourth attachment section 51K. The toner replenishing section 5 is an example of a developer supplying section. The toner is an example of a developer.

A first toner container 52Y is attached to the first attachment section 51Y. Similarly, a second toner container 52C is attached to the second attachment section 51C, a third toner container 52M is attached to the third attachment section 51M, and a fourth toner container 52K is attached to the fourth attachment section 51K. Note that the configurations of the first to fourth attachment sections 51Y to 51K are the same as each other aside from different types of toner container being attached thereto. As such, the first to fourth attachment sections 51Y to 51K may be generically referred to as an "attachment section 51".

The first toner container 52Y, the second toner container 52C, the third toner container 52M, and the fourth toner container 52K contain respective toners. In the present embodiment, the first toner container 52Y contains a yellow toner. The second toner container 52C contains a cyan toner. The third toner container 52M contains a magenta toner. The fourth toner container 52K contains a black toner.

The image forming section 6 includes a light exposure device 61, a first image forming unit 62Y, a second image forming unit 62C, a third image forming unit 62M, and a fourth image forming unit 62K.

Each of the first to fourth image forming units 62Y to 62K includes a charger 63, a development device 64, and a photosensitive drum 65. The photosensitive drum 65 is an example of an image bearing member.

The charger 63 and the development device 64 are arranged along the peripheral surface of the photosensitive drum 65. In the present embodiment, the photosensitive drum 65 rotates in a (clockwise) direction indicated by an arrow R1 in FIG. 1.

The charger 63 uniformly charges the photosensitive drum 65 to a prescribed polarity by electrical discharge. In the present embodiment, the charger 63 charges the photosensitive drum 65 to a positive polarity. The light exposure device 61 emits laser light to the charged photosensitive drum 65. In this manner, an electrostatic latent image is formed on the surface of the photosensitive drum 65.

The development device 64 develops the electrostatic latent image formed on the surface of the photosensitive drum 65 into a toner image. The development device 64 is replenished with a toner from the toner replenishing section 5. The development device 64 supplies the toner supplied from the toner replenishing section 5 to the surface of the photosensitive drum 65. As a result, a toner image is formed on the surface of the photosensitive drum 65.

In the present embodiment, the development device 64 in the first image forming unit 62Y is connected to the first attachment section 51Y. Accordingly, the yellow toner is supplied to the development device 64 in the first image forming unit 62Y. Accordingly, a yellow toner image is formed on the surface of the photosensitive drum 65 in the first image forming unit 62Y.

The development device 64 in the second image forming unit 62C is connected to the second attachment section 51C. Accordingly, the cyan toner is supplied to the development device 64 in the second image forming unit 62C. Accordingly, a cyan toner image is formed on the surface of the photosensitive drum 65 in the second image forming unit 62C.

The development device 64 in the third image forming unit 62M is connected to the third attachment section 51M. Accordingly, the magenta toner is supplied to the development device 64 in the third image forming unit 62M. Accordingly, a magenta toner image is formed on the surface of the photosensitive drum 65 in the third image forming unit 62M.

The development device 64 in the fourth image forming unit 62K is connected to the fourth attachment section 51K. Accordingly, the black toner is supplied to the development device 64 in the fourth image forming unit 62K. Accordingly, a black toner image is formed on the surface of the photosensitive drum 65 in the fourth image forming unit 62K.

The transferring section 7 transfers the toner images formed on the surfaces of the respective photosensitive drums 65 in the first to fourth image forming units 62Y to 62K to a sheet P in a superimposed manner. In the present embodiment, the transferring section 7 transfers the toner images to the sheet P in a superimposed manner by secondary transfer. In detail, the transferring section 7 includes four primary transfer rollers 71, an intermediate transfer belt 72, a drive roller 73, a driven roller 74, a secondary transfer roller 75, and a density sensor 76.

The intermediate transfer belt 72 is an endless belt stretched between the four primary transfer rollers 71, the drive roller 73, and the driven roller 74. The intermediate transfer belt 72 is driven according to the rotation of the drive roller 73. In FIG. 1, the intermediate transfer belt 72 circles counterclockwise. The driven roller 74 is driven to rotate according to the driving of the intermediate transfer belt 72.

The first to fourth image forming units 62Y to 62K are arranged opposite to a lower surface of the intermediate transfer belt 72 in a moving direction D of the lower surface of the intermediate transfer belt 72. In the present embodiment, the first to fourth image forming units 62Y to 62K are arranged in order from upstream to downstream in the moving direction D of the lower surface of the intermediate transfer belt 72.

Each of the primary transfer rollers 71 is arranged opposite to a corresponding photosensitive drum 65 with the intermediate transfer belt 72 therebetween and pressed against the photosensitive drum 65. As such, the toner image formed on the surface of each photosensitive drum 65 is sequentially transferred to the intermediate transfer belt 72. In the present embodiment, the yellow toner image, the cyan toner image, the magenta toner image, and the black toner image are transferred in the stated order to the intermediate transfer belt 72 in a superimposed manner. In the following, a toner image generated by superimposing the yellow toner image, the cyan toner image, the magenta toner image, and the black toner image may be referred to as a "layered toner image".

The secondary transfer roller 75 is arranged opposite to the drive roller 73 with the intermediate transfer belt 72 therebetween. The secondary transfer roller 75 is pressed against the drive roller 73. Accordingly, a transfer nip is formed between the secondary transfer roller 75 and the drive roller 73. When the sheet P passes through the transfer nip, the layered toner image on the intermediate transfer belt 72 is transferred to the sheet P. In the present embodiment, the yellow toner image, the cyan toner image, the magenta toner image, and the black toner image are transferred to the sheet P so as to be superimposed in the stated order from a top layer to a bottom layer. The sheet P to which the layered toner image has been transferred is conveyed to the fixing section 8 by the conveyance section 4.

The density sensor 76 is arranged opposite to the intermediate transfer belt 72 downstream of the first to fourth image forming units 62Y to 62K and measures the density of the layered toner image formed on the intermediate transfer belt 72. Note that the density sensor 76 may measure the density of the layered toner image on the photosensitive drum 65 or may measure the density of the toner image fixed to the sheet P.

The fixing section 8 includes a heating member 81 and a pressure member 82. The heating member 81 and the pressure member 82 are arranged opposite to each other and form a fixing nip. The sheet P conveyed from the image forming section 6 receives pressure while being heated to a prescribed temperature by passing through the fixing nip. As a result, the layered toner image is fixed to the sheet P. The sheet P is conveyed from the fixing section 8 to the ejection section 9 by the conveyance section 4.

The ejection section 9 includes an ejection roller pair 91 and an exit tray 93. The ejection roller pair 91 conveys the sheet P to the exit tray 93 through an exit port 92. The exit port 92 is formed in an upper part of the image forming apparatus 1.

The controller 10 controls the operation of each element included in the image forming apparatus 1. The controller 10 includes a processor 11, storage 12, and an estimating section 13. The processor 11 includes a central processing unit (CPU), for example. The storage 12 includes memory such as semiconductor memory and may include a hard disk drive (HDD). The storage 12 stores therein items such as a control program and control information related to control of the image forming apparatus 1. The processor 11 controls the operation of the image forming apparatus 1 by executing the control program. For example, the processor 11 functions as the estimating section 13 by executing the control program. The estimating section 13 estimates an amount of toner moved due to later-described fogging.

Figure 2:
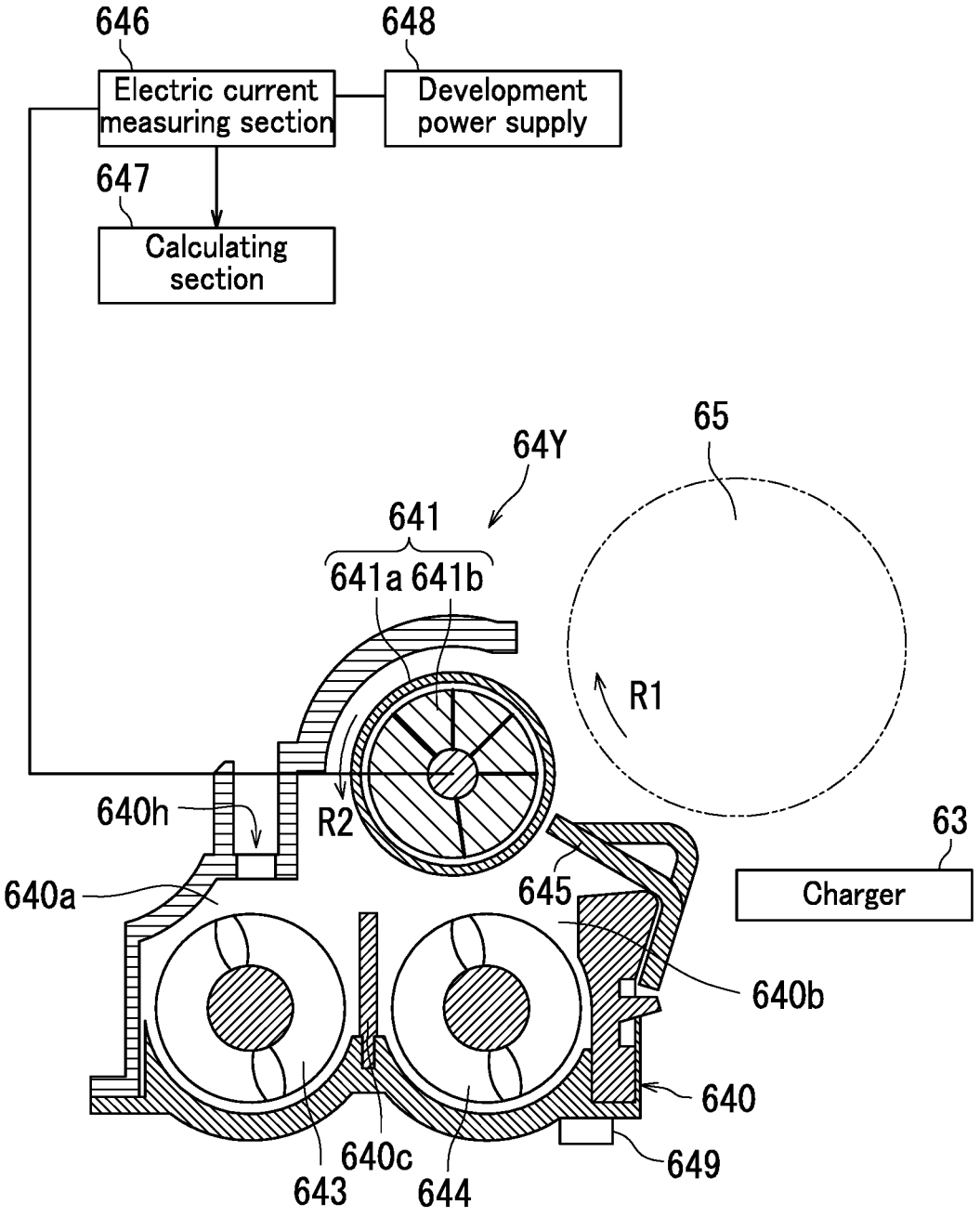
FIG. 2 is a diagram illustrating an example of the configuration of a development device in the embodiment.

Next, a configuration of a development device 64 is described in detail with reference to FIG. 2. FIG. 2 is a diagram illustrating an example of the configuration of the development device 64. In detail, FIG. 2 illustrates the first development device 64Y in the first image forming unit 62Y. Note that in FIG. 2, the photosensitive drum 65 is illustrated with a dashed and double dotted line to facilitate understanding. In the present embodiment, the first development device 64Y develops an electrostatic latent image formed on the surface of the photosensitive drum 65 using two-component development. A developer container 640 of the first development device 64Y is connected to the first toner container 52Y. Accordingly, the yellow toner is supplied to the developer container 640 of the first development device 64Y through a toner replenishment port 640*h*.

As illustrated in FIG. 2, the first development device 64Y includes a development roller 641, a first stirring screw 643, a second stirring screw 644, and a blade 645 inside the developer container 640. In detail, the development roller 641 is arranged opposite to the second stirring screw 644. The blade 645 is arranged opposite to the development roller 641.

The developer container 640 is divided into a first stirring compartment 640*a* and a second stirring compartment 640*b* by a dividing wall 640*c*. The dividing wall 640*c* extends in the axial direction of the development roller 641. The first stirring compartment 640*a* and the second stirring compartment 640*b* communicate with each other outside each of the opposite ends of the dividing wall 640*c* in a longitudinal direction thereof. A toner density sensor 649 is attached to a base surface of the second stirring compartment 640*b*.

The first stirring screw 643 is arranged in the first stirring compartment 640*a*. A magnetic carrier is housed in the first stirring compartment 640*a*. A non-magnetic toner is supplied to the first stirring compartment 640*a* through the toner replenishment port 640*h*. In the example illustrated in FIG. 2, the yellow toner is supplied to the first stirring compartment 640*a*.

The second stirring screw 644 is arranged in the second stirring compartment 640*b*. A magnetic carrier is housed in the second stirring compartment 640*b*.

The yellow toner is stirred and mixed with the carrier by the first stirring screw 643 and the second stirring screw 644. As a result, a two-component developer is generated from the carrier and the yellow toner. Because the two-component developer is an example of a developer, the two-component developer may be referred to in the following simply as a "developer".

The toner density sensor 649 detects the toner density in the developer of the first development device 64Y. The toner density sensor 649 is a magnetic sensor which detects the density of the developer by detecting the magnetic permeability of the developer, for example.

The first stirring screw 643 and the second stirring screw 644 stir the developer by circulating the developer between the first stirring compartment 640*a* and the second stirring compartment 640*b*. As a result, the toner is charged to a prescribed polarity. In the present embodiment, the toner is charged to a positive polarity.

The development roller 641 includes a non-magnetic rotating sleeve 641*a* and a magnetic body 641*b*. The magnetic body 641*b* is secured and arranged inside the rotating sleeve 641*a*. The magnetic body 641*b* has a plurality of magnetic poles. The developer is attracted to the development roller 641 through the magnetic force of the magnetic body 641*b*. As a result, a magnetic brush is formed on the surface of the development roller 641.

In the present embodiment, the development roller 641 rotates in a (counterclockwise) direction indicated by an arrow R2 in FIG. 2. The development roller 641 conveys the magnetic brush to a position opposite to the blade 645 by rotating. The blade 645 is arranged such that a gap (space) is formed between the development roller 641 and the blade 645. Accordingly, the thickness of the magnetic brush is defined by the blade 645. The blade 645 is arranged upstream in the rotational direction of the development roller 641 of a position at which the development roller 641 and the photosensitive drum 65 are opposite to each other.

A prescribed voltage is applied to the development roller 641. Thus, a layer of the developer formed on the surface of the development roller 641 is conveyed to a position opposite to the photosensitive drum 65 and the toner in the developer is attached to the photosensitive drum 65.

Specifically, the first development device 64Y further includes an electric current measuring section 646, a calculating section 647, and a development power supply 648.

The electric current measuring section 646 is connected between the development power supply 648 and the development roller 641, for example. The development power supply 648 applies a prescribed bias voltage to the development roller 641 of the first development device 64Y. The electric current measuring section 646 measures a development current flowing between the photosensitive drum 65 and the development roller 641 according to the bias voltage applied by the development power supply 648. The electric current measuring section 646 is an ammeter, for example, and measures the electric current value of the development current. The calculating section 647 includes a central processing unit (CPU), for example. The CPU functions as the calculating section 647 through the processor 11 executing the control program. Note that the CPU functioning as the calculating section 647 may be the processor 11.

Figure 3A:
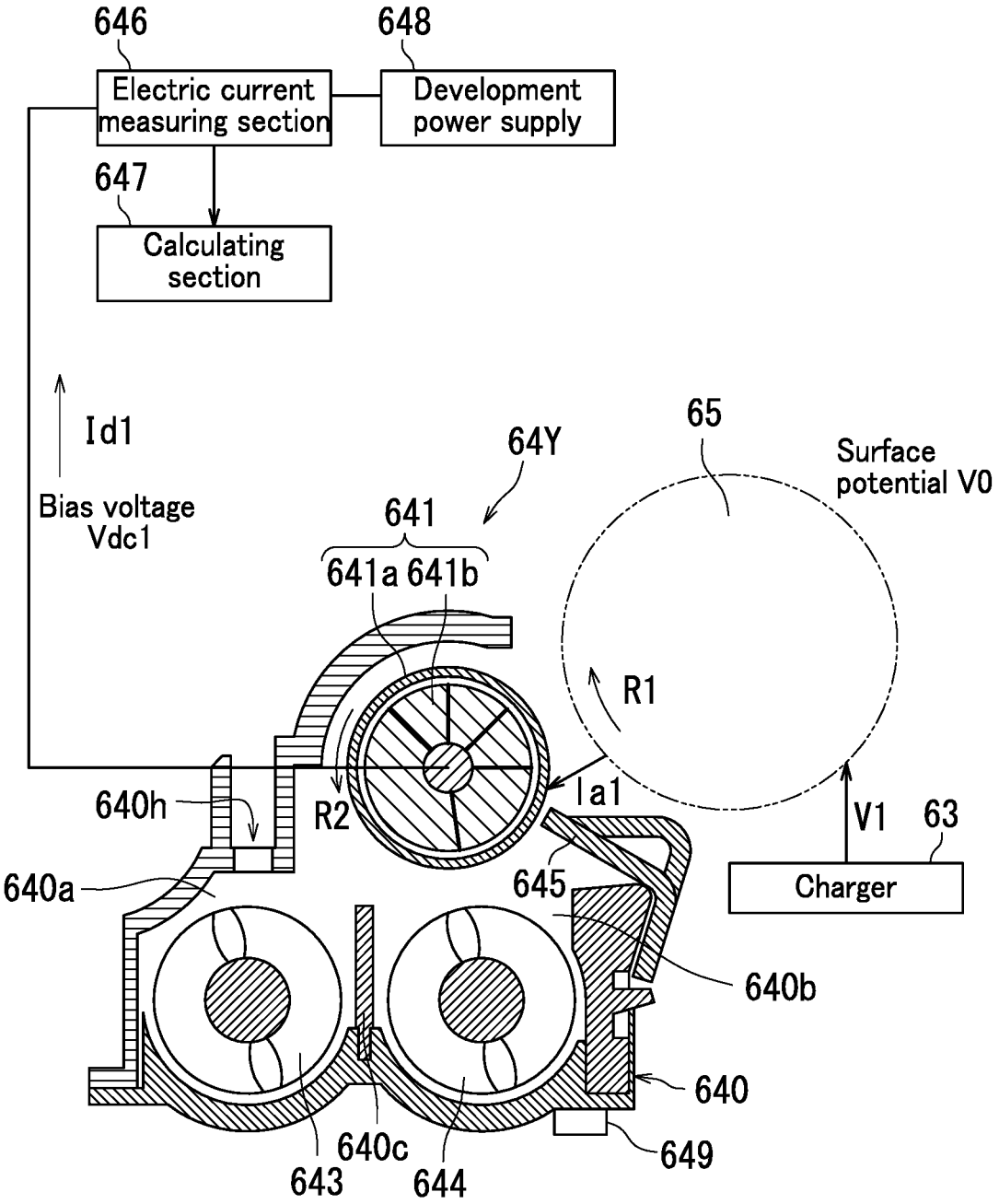
FIG. 3A is a diagram illustrating a development current measured by an electric current measuring section in the embodiment.
Figure 3B:
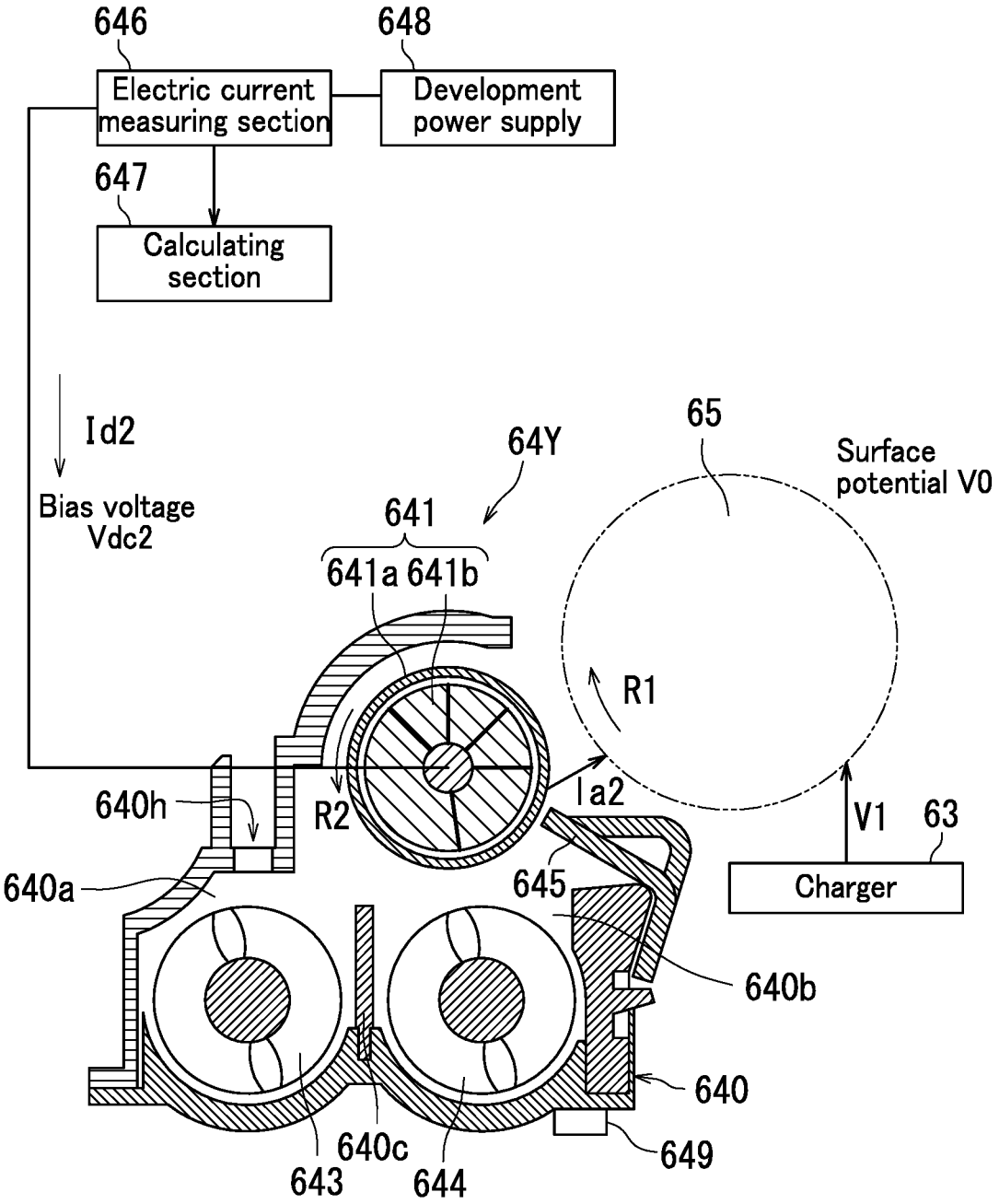
FIG. 3B is another diagram illustrating the development current measured by the electric current measuring section.

Next, the development current flowing in the first development device 64Y is described with reference to FIGS. 3A and 3B. FIGS. 3A and 3B are diagrams illustrating the development current measured by the electric current measuring section 646.

For example, the electric current measuring section 646 measures the electric current value of the development current while the first development device 64Y is developing an electrostatic latent image formed on the surface of the photosensitive drum 65.

In the present embodiment, when the user inputs an instruction indicating execution of image formation processing to the image forming apparatus 1, the controller 10 causes the image forming section 6 to start the image formation operation with corresponding elements included in the image forming apparatus 1. Specifically, the controller 10 controls the charger 63, the first development device 64Y, the development power supply 648, and the light exposure device 61.

The charger 63 charges the surface of the photosensitive drum 65 to a prescribed charge potential (surface potential V0) under control of the controller 10. In detail, when the charger 63 applies a charging bias to the photosensitive drum 65, the surface of the photosensitive drum 65 is charged to the surface potential V0.

The development power supply 648 applies a bias voltage to the development roller 641 under control of the controller 10. The bias voltage includes a direct current (DC) component and an alternating current (AC) component. FIG. 3A illustrates a case in which a bias voltage (Vdc1) with a DC component having a potential smaller than the surface potential V0 is applied to the development roller 641. Note that the bias voltage may not include an AC component.

The light exposure device 61 emits laser light to the photosensitive drum 65 charged to the surface potential V0 by the charger 63 under control of the controller 10. Thus, an electrostatic latent image is formed on the surface of the photosensitive drum 65.

Once an electrostatic latent image is formed on the surface of the photosensitive drum 65, the first development device 64Y develops the electrostatic latent image formed on the surface of the photosensitive drum 65 under control of the controller 10.

At this time, the electric current measuring section 646 measures the electric current value of the development current. In FIG. 3A, a development current Id1 is a combined electric current including an electric current that flows when toner in the magnetic brush formed on the development roller 641 moves to the development roller 641 and an electric current Ia1 flowing from the photosensitive drum 65 through the magnetic brush formed on the development roller 641.

FIG. 3B illustrates a case in which a bias voltage (Vdc2) with a DC component having a potential greater than the surface potential V0 is applied to the development roller 641. In FIG. 3B, a development current Id2 is a combined electric current including an electric current Ia2 flowing when the toner is supplied to the photosensitive drum 65 and an electric current that flows to the photosensitive drum 65 through the magnetic brush formed on the development roller 641.

As such, when the DC component of the bias voltage has a potential greater than the surface potential V0, the direction of the development current measured by the electric current measuring section 646 is reversed from the case in which the DC component of the bias voltage has a potential smaller than the surface potential V0.

Furthermore, when the DC component of the bias voltage has a potential equal to the surface potential V0, the development electric field intensity is zero and the development current is zero. Because of this, the potential of the DC component of the bias voltage is determined to be the surface potential V0 when the development current is zero.

Figure 4:
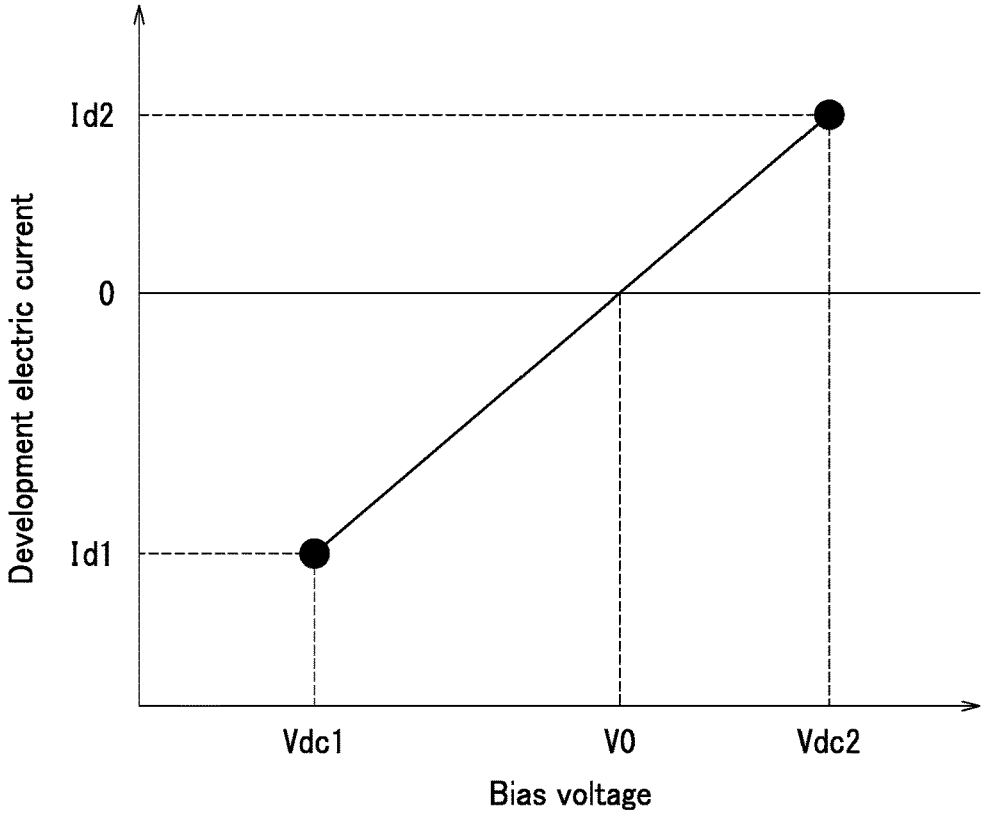
FIG. 4 is a graph illustrating a correspondence between the development current and a bias voltage.
Figure 5:
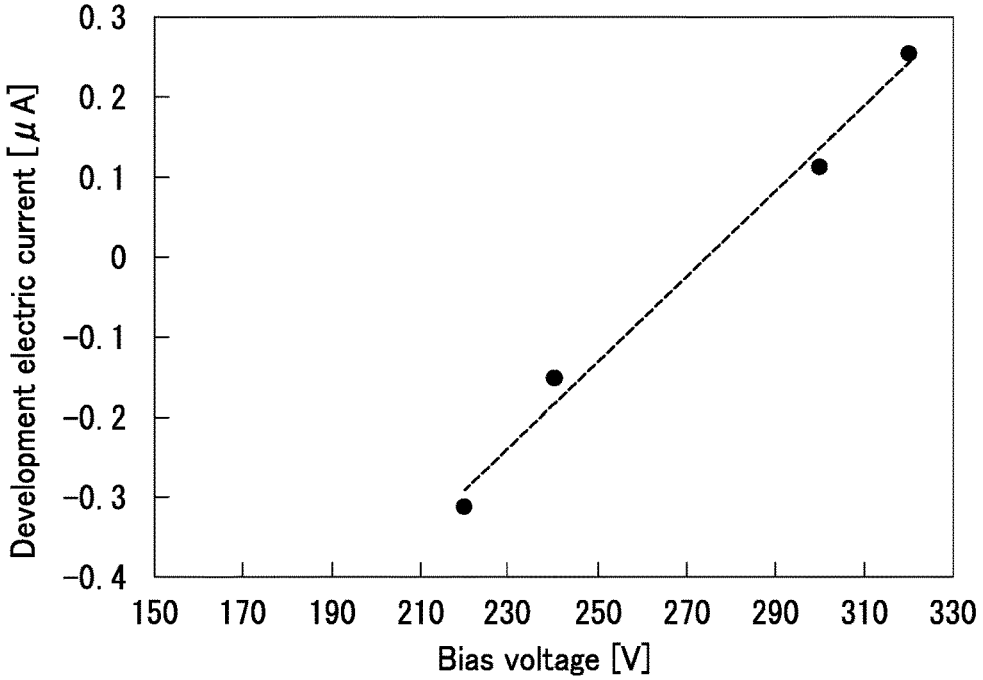
FIG. 5 is a diagram illustrating a specific example of the graph shown in FIG. 4.

Next, calculation of the surface potential is described with reference to FIGS. 3 to 5. FIG. 4 is a graph illustrating a correspondence between the development current and the bias voltage. FIG. 5 is a diagram illustrating a specific example of the graph shown in FIG. 4. FIGS. 4 and 5 indicate the development current on the vertical axes thereof and the bias voltage on the horizontal axes thereof.

For example, the development power supply 648 applies the bias voltage Vdc1 to the development roller 641. At this time, the electric current measuring section 646 measures the electric current value of the development current Id1. The calculating section 647 acquires the electric current values of the bias voltage Vdc1 being applied by the development power supply 648 and the electric current value of the development current Id1 measured by the electric current measuring section 646 (FIG. 3A).

Specifically, under the following conditions, a development current Id1 of −0.31 μA is measured when a bias voltage Vdc1 of 220 V is applied, and a development current Id1 of −0.15 μA is measured when a bias voltage Vdc1 of 240 V is applied.

Photosensitive drum 65: amorphous silicon (a-Si) drum
Thickness of photosensitive drum 65: 20 μm
Charger 63: outer diameter of metal core of charging roller—6 mm, rubber thickness—3 mm, rubber resistance—6.0 Log Ω
Charging bias: DC only
Blade 645: SUS 430, magnetic
Thickness of blade 645: 1.5 mm
Surface profile of development roller 641: subjected to knurling and blasting
Outer diameter of development roller 641: 20 mm
Recesses of development roller 641: 80 rows in circumferential direction
Peripheral speed of development roller 641/peripheral speed of photosensitive drum 65: 1.8
Distance between development roller 641 and photosensitive drum 65: 0.30 mm
AC component of bias voltage: Vpp—1200 V, duty—50%, rectangular waveform, 8 kHz
Toner: Particle diameter—6.8 μm, positively chargeable
Carrier: particle diameter—38 μm, ferrite resin coated carrier
Toner density: 6%
Printing speed: 55 sheets per minute Furthermore, the development power supply 648 applies the bias voltage Vdc2 to the development roller 641. At this time, the electric current measuring section 646 measures the electric current value of the development current Id2. The calculating section 647 acquires the bias voltage Vdc2 being applied by the development power supply 648 and the electric current value of the development current Id2 measured by the electric current measuring section 646 (FIG. 3B).

Specifically, under the above conditions, a development current Id2 of 0.12 μA is measured when a bias voltage Vdc2 of 300 V is applied, and a development current Id2 of 0.26 μA is measured when a bias voltage Vdc2 of 320 V is applied.

In the present embodiment, the difference between the bias voltage Vdc1 and the bias voltage Vdc2 is preferably about 100 V, and more preferably about 50 V.

Based on the acquired bias voltage Vdc1, development current Id1, bias voltage Vdc2, and development current Id2, the calculating section 647 calculates, as the surface potential V0, a bias voltage at which the development current stops flowing.

Specifically, in the above example, a surface potential V0 of 273 V is calculated (FIG. 5).

In the present embodiment, the configuration of the development devices 64 included in the respective first to fourth image forming units 62Y to 62K is substantially identical aside from the type of toner being supplied thereto from the toner replenishing sections 5. Accordingly, description of the configuration of the second to fourth development devices 64C to 64K in the respective second to fourth image forming units 62C to 62K is omitted.

For example, the controller 10 determines a bias voltage Vdc to be applied to the development roller 641 by the development power supply 648 based on the surface potential V0 calculated by the calculating section 647.

Therefore, when an electrostatic latent image is developed, a bias voltage with an adequate potential difference can be applied to the development roller 641 and a higher quality image can be formed.

However, even when the development electric field intensity is zero in the image forming apparatus 1, a development current may be observed that is due to low-charged toner with a weak electrostatic binding force being attached to and moving on the photosensitive drum 65 (fogging).

(Estimation of Amount of Toner Moved Due to Fogging)

In the present embodiment, the development current that flows when the development electric field intensity is zero increases and deviates from zero as the amount of toner moved due to fogging increases. Therefore, the difference between the actual surface potential and the calculated surface potential increases when the surface potential is estimated to be equal to the potential of the DC component of the bias voltage in a case in which the development current is zero (FIG. 4). Furthermore, frequent measurement of the development current reduces productivity. When the amount of toner moved due to fogging is small by contrast, the development current may be set to zero.

In view of the foregoing, the estimating section 13 estimates an amount of toner moved due to fogging. For example, the estimating section 13 estimates an amount of toner moved due to fogging (fogging toner amount) based on one or more parameters.

Specifically, one example of the parameters is the toner density of a toner image developed by a development device 64. As the toner density increases, the fogging toner amount increases because fogging easily occurs. The estimating section 13 acquires a toner density Tc detected by the toner density sensor 649.

Another example of the parameters is a toner charge amount TQ which is an amount of charge of the toner supplied to the photosensitive drum 65 by the development device 64. As the toner charge amount TQ decreases, fogging easily occurs. Accordingly, the fogging toner amount increases.

The estimating section 13 acquires the toner charge amount TQ. Specifically, the estimating section 13 acquires the development current Id measured by the electric current measuring section 646 of each development device 64. For example, each electric current measuring section 646 stores the electric current value of a measured development current Id in the storage 12. The estimating section 13 acquires the electric current values of the development currents Id from the storage 12 and calculates respective development charge amounts Q by integrating the respective measured electric current values with time.

Furthermore, the estimating section 13 refers to a density table showing the relationship between the toner density Tc and a developed toner amount M to convert the acquired toner density Tc into a developed toner amount M. The density table is stored in the storage 12, for example.

The estimating section 13 calculates the ratio of the toner development amount M to a corresponding development charge amount Q as the toner charge amount TQ.

Another example of the parameters is a carrier resistance value CR indicating difficulty of flow for a carrier current that flows in the carrier from the photosensitive drum 65 to the development roller 641 when toner is not moving. The carrier current is an electric current that flows when the bias voltage Vdc1 is smaller than the surface potential V0 as illustrated in FIG. 3A. As the carrier resistance value CR decreases, fogging easily occurs. Accordingly, the fogging toner amount increases.

The estimating section 13 acquires the carrier resistance value CR. Specifically, the estimating section 13 for example acquires the electric current value of the development current Id flowing in the direction of the development current Id1 illustrated in FIG. 3A from the storage 12 and divides the corresponding bias voltage applied to the development roller 641 by the acquired electric current value to calculate the carrier resistance value CR.

Another example of the parameters is a voltage value Vac of the AC component of the bias voltage. The voltage value Vac is a value such as the actual value, maximum value, or average value of the AC component of the bias voltage. As the voltage value Vac decreases, the electric field effect which removes toner with a small amount of charge from the photosensitive drum 65 to the development roller 641 becomes small. This allows fogging to easily occur and increases the fogging toner amount.

The estimating section 13 acquires the voltage value Vac of the AC component of the bias voltage applied to the development roller 641.

Another example of the parameters is a coverage rate CV in one minute prior to estimation of the fogging toner amount. The coverage rate CV can be thought of as the density of the toner attached to the development roller 641. As the coverage rate CV increases, the toner developability temporarily decreases and fogging hardly occurs. Accordingly, the fogging toner amount decreases. The estimating section 13 for example acquires the coverage rate CV in one minute prior to estimation of the fogging toner amount from the storage 12 as an example of the control information.

The estimating section 13 for example estimates as a fogging toner amount A the value obtained by multiplying the acquired parameters by respective arbitrary constants a to e and adding them together (formula 1).

$$A=a*Tc+b*TQ+c*CR+d*Vac+e*CV \quad \text{(formula 1)}$$

Note that formula 1 includes five parameters, but one or more of the five parameters may not be included. For example, only a toner density Tc and a toner charge amount TQ which have a particularly large influence on the fogging toner amount A may be included.

Furthermore, formula 1 may include an even greater number of parameters. Another example of the parameters is a frequency F of the AC component of the bias voltage. As the frequency F decreases, the electric field effect which removes toner with a small amount of charge from the photosensitive drum 65 to the development roller 641 decreases to allow fogging to easily occur. Accordingly, the fogging toner amount A increases.

When the fogging toner amount A estimated by the estimating section 13 is less than a prescribed threshold B, the controller 10 for example controls the charger 63, the first development device 64Y, the development power supply 648, and the calculating section 647 so as to calculate the surface potential.

Note that the controller 10 may determine a bias voltage Vdc applied to the development roller 641 based on a surface potential obtained by a method other than calculation by the calculating section 647. For example, in a case in which image formation is performed on a plurality of sheets P, the controller 10 determines the bias voltage Vdc based on the surface potential V0 calculated by the calculating section 647 during image formation on the first sheet P, and determines the bias voltage Vdc based on a predetermined surface potential or a surface potential estimated through another method during image formation on the second and later sheets P.

In the present embodiment, in addition to the above parameters, examples of the parameters for estimating the fogging toner amount A include the advection-diffusion coefficient of the developer. By measuring the advection-diffusion coefficient of the developer in the present embodiment, whether or not the image forming apparatus 1 is in a state in which fogging occurs easily can be determined because the time until supplied toner reaches the development nip (between the photosensitive drum 65 and the development roller 641) can be understood based on the supply amount and supply timing of the toner.

Furthermore, in the present embodiment, toner ejection may be performed to forcefully eject toner from the development device 64. When toner ejection is performed, the developability of the toner temporarily decreases which allows fogging to easily occur. Accordingly, the fogging toner amount A decreases. The parameters for measuring the fogging toner amount A may for example include information indicating whether or not toner ejection has been performed.

Also in the present embodiment, the calculating section 647 for example determines a newly calculated surface potential to be a measurement error when the calculated surface potential differs from a previously calculated surface potential by a prescribed reference value or greater. In this case, the calculating section 647 may recalculate the surface potential or may set the previously calculated surface potential as the result of calculation.

Also in the present embodiment, by storing the surface potential calculated by the calculating section 647, change in the surface potential of the photosensitive drum 65 can be observed and degradation of elements such as the charger 63 and the photosensitive drum 65 can be estimated.

In the present embodiment, the light exposure device 61 does not emit laser light to the photosensitive drum 65 during measurement of the development current by the electric current measuring section 646. As such, by performing measurement of the development current using an unexposed area of the photosensitive drum 65, the development current mainly includes electric current caused by the movement of the carrier. This is because little toner scattering occurs in a blank area even when fogging occurs. Accordingly, the surface potential of the photosensitive drum 65 can be measured with high accuracy. Note that the surface potential may be calculated by measuring a non-charging development current and a charging development current using an exposed area after emission of laser light by the light exposure device 61.

Furthermore, in the present embodiment, the photosensitive drum 65 is a positively chargeable organic photoconductor (OPC) drum or an amorphous silicon drum. When an amorphous silicon drum is used as the photosensitive drum 65, measurement accuracy increases because the conductivity of the photosensitive layer is higher than that of a positively chargeable OPC drum, electric current flows easily, and the carrier resistance value CR is low.

Also in the present embodiment, a two-component developer was used, but the developer is not limited as such and a one-component developer may be used.

Figure 6:
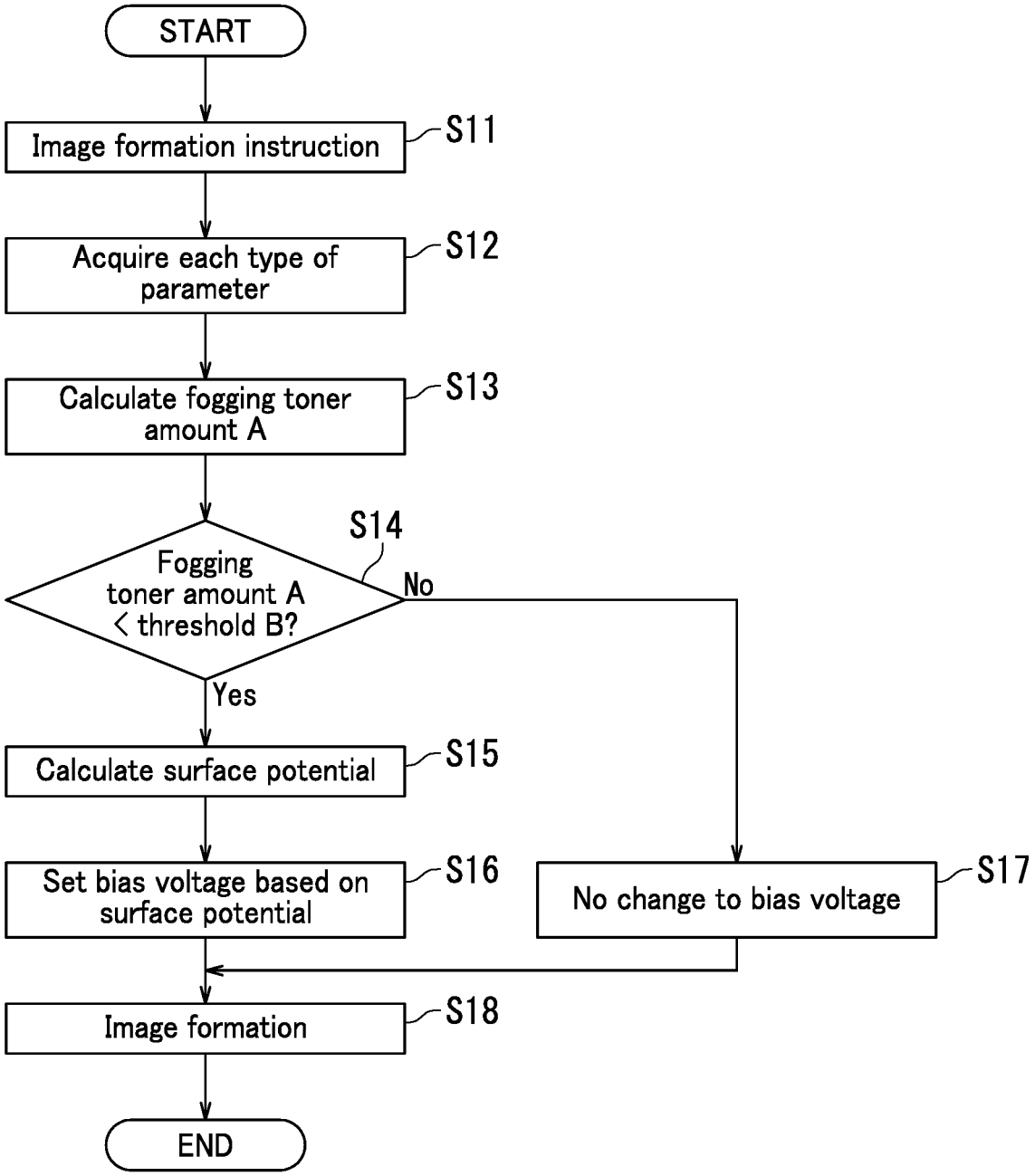
FIG. 6 is a flowchart depicting a surface potential calculation process in the embodiment.

Next, a surface potential calculation process according to the present embodiment is described with reference to FIG. 6. FIG. 6 is a flowchart depicting the surface potential calculation process according to the present embodiment.

First, when a user inputs an instruction indicating execution of image formation processing to the image forming apparatus 1 (Step S11), the estimating section 13 acquires parameter values (Step S12).

The estimating section 13 calculates the fogging toner amount A based on the acquired parameter values (Step S13).

When the fogging toner amount A estimated by the estimating section 13 is less than the prescribed threshold B (Yes in Step S14), the controller 10 causes the calculating section 647 to calculate the surface potential (Step S15).

The controller 10 sets the bias voltage Vdc to be applied to the development roller 641 based on the surface potential V0 calculated by the calculating section 647 (Step S16) and causes the image forming section 6 to form an image on a sheet P (Step S18).

When the fogging toner amount A estimated by the estimating section 13 is equal to or greater than the prescribed threshold B by contrast (No in Step S14), the controller 10 does not change the current bias voltage set based on a predetermined surface potential, a surface potential estimated through another method, or a surface potential previously calculated by the calculating section 647 (Step S17), and causes the image forming section 6 to form an image on the sheet P (Step S18).

An embodiment of the present disclosure is described above with reference to the accompanying drawings (FIGS. 1 to 6). However, the present disclosure is not limited to the above embodiment and may be implemented in various manners within a scope not departing from the gist thereof. The drawings mainly illustrate various constituent elements schematically to facilitate understanding thereof. Aspects such as thickness, length, and number of the constituent elements illustrated in the drawings may differ in practice for convenience of drawing preparation. Furthermore, aspects such as material, dimension, and shape of the constituent elements illustrated in the above embodiments are examples and not particular limitations. The constituent elements may be variously altered within a scope not substantially departing from the effects of the present disclosure.

What is claimed is:

1. An image forming apparatus comprising:

an image bearing member with a surface on which an electrostatic latent image is formed; a charger configured to charge the image bearing member;

a development device configured to develop the electrostatic latent image formed on the image bearing member into a toner image by supplying a toner to the image bearing member;

a development power supply configured to apply a bias voltage to the development device;

an electric current measuring section configured to measure a development current flowing in the development device;

a calculating section configured to calculate a surface potential of the image bearing member based on the development current measured by the electric current measuring section; and an estimating section configured to estimate a fogging toner amount, the fogging toner amount being an amount of toner moved due to fogging, wherein the electric current measuring section measures the development current that flows in the development device in a charged state in which the charger has charged the image bearing member, when the fogging toner amount estimated by the estimating section is less than a prescribed threshold, the calculating section calculates a value of the bias voltage at which the development current stops flowing as the surface potential, and when the fogging toner amount estimated by the estimating section is less than the prescribed threshold, the development power supply applies a bias voltage for image formation according to the surface potential calculated by the calculating section.

2. An image forming apparatus according to claim 1, wherein the estimating section estimates the fogging toner amount based on one or more parameters including any of the following: toner density of the toner image developed by the development device; an amount of charge of the toner; a carrier resistance indicating difficulty of flow for an electric current that flows in a carrier when the toner is not moving; a voltage value of an AC component of the bias voltage; and a coverage rate in one minute prior to estimation of the fogging toner amount.

3. The image forming apparatus according to claim 1, wherein at different times, the development power supply applies the bias voltage such that an electric current flows in a direction from the image bearing member to the development device, and applies the bias voltage such that an electric current flows in a direction from the development device to the image bearing member.

4. The image forming apparatus according to claim 1, wherein the calculating section calculates the surface potential before image formation processing is performed by which the image forming apparatus forms an image on a recording medium.

5. The image forming apparatus according to claim 1, wherein the electric current measuring section measures the development current in an unexposed state of the image bearing member.

* * * * *